United States Patent [19]

Hori

[11] Patent Number: 4,706,562

[45] Date of Patent: Nov. 17, 1987

[54] PRINTING MECHANISM HAVING ONE ELECTROMAGNETIC SELECTOR FOR TWO TYPE RINGS

[75] Inventor: Fumihisa Hori, Tamayama, Japan

[73] Assignee: Alps Electric Co., Ltd., Japan

[21] Appl. No.: 820,552

[22] Filed: Jan. 17, 1986

[30] Foreign Application Priority Data

| | | | |
|---|---|---|---|
| Jan. 17, 1985 | [JP] | Japan | 60-4851 |
| Jan. 17, 1985 | [JP] | Japan | 60-3619[U] |
| Jan. 17, 1985 | [JP] | Japan | 60-3623[U] |

[51] Int. Cl.[4] ..... B41J 1/48

[52] U.S. Cl. ..... 101/93.22; 101/99; 101/110; 101/93.11

[58] Field of Search ..... 101/93.18, 93.19, 93.21, 101/93.22, 93.23, 95, 99, 106, 109, 110, 93.11, 93.12, 93.09; 192/84 B, 84 C

[56] References Cited

U.S. PATENT DOCUMENTS

| | | | |
|---|---|---|---|
| 2,203,024 | 6/1940 | Lewis et al. | 192/84 C |
| 3,315,860 | 4/1967 | Adams et al. | 400/568 |
| 3,848,527 | 11/1974 | Nihira | 101/93.31 |
| 3,890,894 | 6/1975 | Nihira | 101/93.18 |
| 3,916,786 | 11/1975 | Clary | 101/99 |
| 4,142,463 | 3/1979 | Matsui et al. | 101/99 |
| 4,508,203 | 4/1985 | Packard et al. | 192/84 C |

FOREIGN PATENT DOCUMENTS

| | | | |
|---|---|---|---|
| 2095181 | 9/1982 | United Kingdom | 400/93.22 |

*Primary Examiner*—Edgar S. Burr
*Assistant Examiner*—David A. Wiecking
*Attorney, Agent, or Firm*—Guy W. Shoup

[57] ABSTRACT

A printing mechanism comprising a rotary shaft, a first type ring mounted on the rotary shaft and provided on the circumference thereof with first typefaces, a first selection ratchet wheeljoined to the first type ring and provided on the circumference thereof with first teeth formed so as to correspond to the first typefaces, respectively, a second type ring mounted on the rotary shaft beside the first type ring and provided on the circumference thereof with second typefaces, a second selection ratchet wheel joined to the second type ring and provided on the circumference thereof with second teeth formed so as to correspond to the second typefaces, respectively, first and second pawls capable of being engaged with and disengaged from the first and second selection ratchet wheels, respectively, by means of an electromagnetic mechanism including a solenoid, a cylindrical yoke, a rotary member fixed to a rotary shaft and the first and second pawls, and clicks capable of transmitting the rotative force of the former rotary shaft to the first and second type rings, respectively. The first and said pawls are controlled by the solenoid so as to stop desired typefaces of the first and second type rings at the printing position.

2 Claims, 6 Drawing Figures

PRINTING MECHANISM HAVING ONE ELECTROMAGNETIC SELECTOR FOR TWO TYPE RINGS

BACKGROUND OF THE INVENTION

1. Field of the Invention

The present invention relates to a printing mechanism and, more particularly, to a printing mechanism including an improved typeface selecting mechanism for stopping rotary type rings.

2. Description of the Prior Art

There has been proposed a conventional printing mechanism having a plurality of type rings, for example, eighteen type rings, each provided with typefaces on the circumference thereof and mounted on a rotary shaft extended in parallel to a platen on which a recording sheet is wound, and adapted to carry out desired printing operation by individually controlling the type rings. Each typering of such a printing mechanism is provided in the body thereof with ratchet teeth and a pawl which engages the ratchet teeth. The printing mechanism is provided with a driving source, such as a solenoid for driving each pawl so that the pawl engages the ratchet teeth or the same is disengaged from the ratchet teeth.

Thus, such a conventional printing mechanism needs one solenoid for stopping one type ring. Accordingly, such a printing mechanism needs a considerable number of parts, requires considerable assembling work and a wide space for accommodating those parts, and hence the manufacturing cost is high and the design condition is restrictive.

SUMMARY OF THE INVENTION

Accordingly, it is an object of the present invention to provide a printing mechanism requiring a reduced number of driving sources for stopping the rotation of the type rings.

The object of the invention is achieved by a printing mechanism comprising: a rotary shaft; a first type ring mounted on the rotary shaft and provided on the circumference thereof with typefaces; a first selection ratchet wheel adapted to rotate together with the first type ring and provided on the circumference thereof withfirst teeth formed so as to correspond to the first typefaces, respectively; a second type ring mounted on the rotary shaft adjacent to the first type ring and provided on the circumference thereof with second typefaces; and a second selection ratchet wheel adapted to rotate together with the second type ring and provided on the circumference thereof with second ratchet teeth formed so as to correspond to the second typefaces, respectively, wherein the first type ring, the first selection ratchet wheel, the second typering and the second selection ratchet wheel are arranged so that the phase of the first teeth and that of the second teeth are different from each other, for example, so that the phase of the second teeth is shifted relative to the phase of the first teeth by half a pitch of the teeth.

The above and other objects, features and advantages of the present invention will become more apparent from the following description of a preferred embodiment thereof taken in conjunction with the accompanying drawings.

DESCRIPTION OF THE PREFERRED EMBODIMENT

A printing mechanism of the present invention will be described hereinafter in conjunction with the accompanying drawings.

Figure 1:
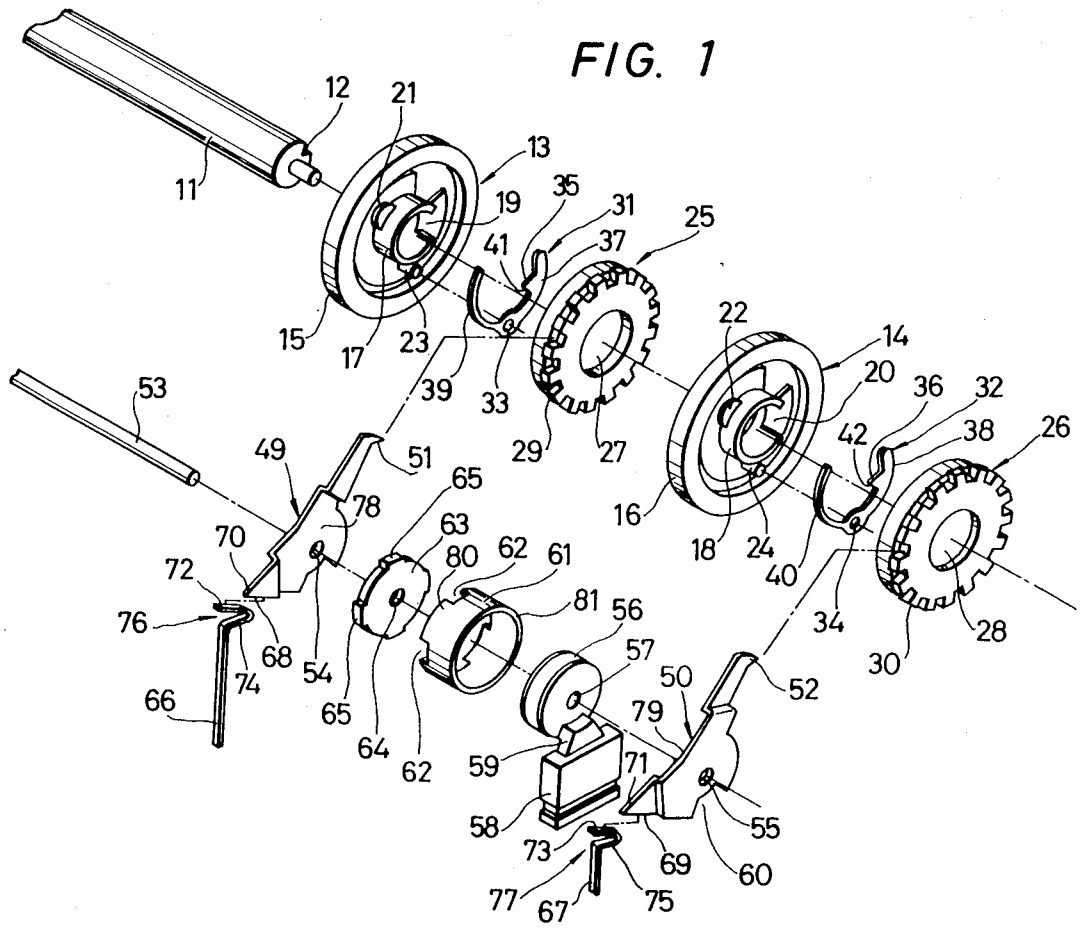
FIG. 1 is an exploded perspective view showing an essential portion of a printing mechanism, in a preferred embodiment, according to the present invention.
Figure 2A:
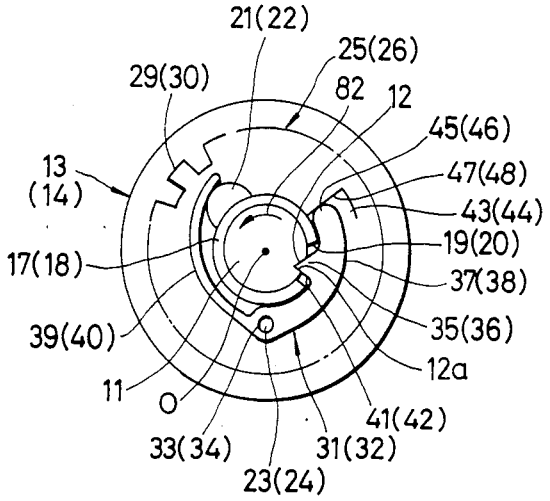
FIGS. 2 (*a*) and 2 (*b*) are views of assistance in explaining the relation between a rotary shaft and a driving click of the embodiment of FIG. 1, in which the rotary shaft and the driving click are engaged in FIG. 2 (*a*), while the rotary shaft and the driving click are disengaged in FIG. 2 (*b*)
Figure 2B:
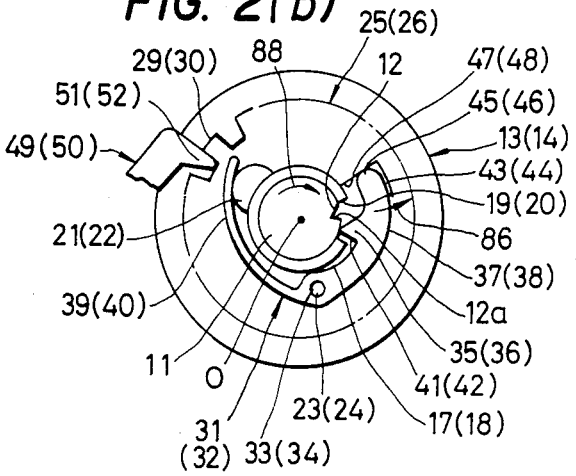

Referring to FIG. 1, indicated at 11 is a rotary shaft having a V-groove 12 formed in the circumference along the center axis thereof. The rotary shaft 11 is extended in parallel to a platen, not shown, on which a recording sheet is wound. As illustrated in FIG. 2 (*b*), the groove 12 has a first face 12*a* extending radially in a radial plane including the center O of the rotary shaft 11. Indicated at 13 and 14 are first and second type rings mounted on the rotary shaft 11, provided on the circumferences thereof with a plurality of first typefaces 15 and a plurality of second typefaces 16 and having in the central portions thereof with bosses 17 and 18 for receiving the rotary shaft therethrough, respectively. Gaps 19 and 20 are formed in the bosses 17 and 18, respectively. Protrusions 21 and 22 are formed in the outer circumferences of the bosses 17 and 18, respectively. Pins 23 and 24 are provided on the type rings 13 and 14 near the bosses 17 and 18, respectively.

Indicated at 25 and 26 are first and second selection ratchet wheels separate from the type rings 13 and 14, fitted on the typerings 13 and 14 so as to rotate together with the type rings 13 and 14, respectively. The ratchet wheels 25 and 26 have holes 27 and 28 formed in the central portions thereof for receiving the bosses 17 and 18 of the type rings 13 and 14, and first teeth 29 and second teeth 30 on the circumferences thereof formed so as to correspond to the typefaces of the type rings 13 and 14, respectively.

Indicated at 31 and 32 are driving clicks disposed between the type ring 13 and the selection ratchet wheel 25 and between the type ring 14 and the selection ratchet wheel 26 to transmit the rotative force of the rotary shart 11 to the type rings 13 and 14, respectively The driving clicks 31 and 32 have holes 33 and 34 in the central portions thereof for rotatably receiving the pins 23 and 24 of the type rings 13 and 14, projections 35 and 36 capable of engaging the groove 12 of the rotary shaft 11, rigid first arms 37 and 38 and elastic second arms 39 and 40, respectively. The projections 35 and 36 have second faces 41 and 42 which fit the first face 12*a* of the groove 11 formed in the rotary shaft 11 shown in FIG. 2 (*b*), respectively.

As illustrated in FIGS. 2 (*a*) and 2 (*b*), the selection ratchet wheels 25 and 26 are provided in the sides facing the type rings 13 and 14 with recesses 43 and 44 capable of accommodating the driving clicks 31 and 32, and guiding faces 47 and 48 where the free ends 45 and 46 of the first arms 37 and 38 of the driving clicks 31 and 32 engages the selection ratchet wheels 25 and 26 movably, respectively, namely, guiding faces 47 and 48 for turning the driving clicks 31 and 32 on the pins 23 and 24, respectively. The protrusions 21 and 22 of the bosses 17 and 18 restrict the approach of the second arms 39 and 40 of the driving clicks 31 and 32 to the bosses 17 and 18, respectively.

The type rings 13 and 14, the driving clicks 31 and 32 and the selection ratchet wheels 25 and 26 are mounted on the rotary shaft 11 in the following manner. For example, the rotary shaft 11 is inserted into the boss 17 of the first type ring 13, then the driving click 31 is put on the first type ring 13 with the pin 23 of the first type ring 13 received in the hole 33 of the driving click 31 and with the projection 35 of the first arm 37 fitted in the gap 19 of the boss 17, and then the projection 35 is engaged with the groove 12 of the rotary shaft 11. The second arm 39 is placed on the protrusion 21 of the boss 17. Then, the rotary shaft 11 is inserted through the hole 27 of the first selection ratchet wheel 25. The first selection ratchet wheel 25 is fitted on the first type ring 13 so that the first teeth 29 correspond to the first typefaces provided on the circumference of the first type ring 13.

Similarly, the rotary shaft 11 is inserted through the boss 18 of the second type ring 14, then the driving click 32 is put on the second type ring 14 with the pin 24 of the second type ring 14 received in the hole 34 of the driving clcik 32 and with the projection 36 of the first arm 38 placed in the gap 20 of the boss 18. Then, the projection 36 is engaged with the groove 12 of the rotary shaft 11. The second arm 40 is placed on the protrusion 22 of the boss 18. Then, the second selection ratchet wheel 26 is fitted on the second type ring 14 so that the second teeth 30 thereof correspond to the second typefaces formed on the circumference of the second type ring 14.

The first type ring 13, the first selection ratchet wheel 25, the second type ring 14 and the second selection ratchet wheel 26 are arranged on the rotary shaft 11 so that the first teeth 29 and the second teeth 30 are different from each other in phase by half a pitch of the teeth, namely, so that the second teeth 30 correspond to the tooth spaces of the first teeth 29, respectively.

In FIG. 1, indicated at 49 and 50 are first and second pawls, respectively, capable of restraining the rotation of the selection ratchets 25 and 26, respectively. The free ends of the selection ratchets 25 and 26 are formed in claws 51 and 52 which engage the teeth 29 and 30 of the selection ratchet wheels 25 and 26, respectively. Holes 54 and 55 for receiving a second rotary shaft 53 therethrough are formed in the central portions of the pawls 49 and 50, respectively.

Indicated at 56 is a driving source, such as a solenoid, having a central hole 57 for rotatably receiving the rotary shaft 53 therethrough. Indicated at 58 is a holder for holding the solenoid 56 in a sectorial projection 59 formed in the upper part thereof. A sectorial recess, (not numbered), corresponding to the shape of the projection of the holder and having a size slightly greater than that of the projection is formed in the lower portion of the first pawl 49. A sectorial recess 60 corresponding to the shape of the projection 59 of the holder 58 and having a size slightly greater than that of the projection 59 is formed in the lower portion of the second pawl 50. Indicated at 61 is a yoke formed so as to surround the solenoid 56 and provided on one side thereof with recesses 62. Indicated at 63 is a nonmagnetic rotary member having a central hole 64 for receiving the rotary shaft 53 and provided on the circumference thereof with protrusions 65 which engage the recesses 62, respectively. The rotary member 63 rotates together with the rotary shaft 53. The solenoid 56, the yoke 61 and the rotary member 63 constitute driving means, namely, an electromagnetic clutch, for turning the first pawl 49 and the second pawl 50.

Indicated at 66 and 67 are spring members capable of holding the pawls 49 and 50 engaged with or disengaged from the selection ratchet wheels 25 and 26, respectively. The spring members 66 and 67 are provided at the upper ends thereof with bends 76 and 77 having upper section 72 and 73 and lower sections 74 and 75 capable of engaging the lower sides 68 and 69 and the upper sides 70 and 71 of the rear ends of the pawls 49 and 50, respectively.

As mentioned above, in assembling the pawls 49 and 50, the solenoid 56 and other parts, the pawls 49 and 50 are mounted on the solenoid, the rotary member 63 is disposed with the protrusions 65 thereof fitted into the recesses 62 of the yoke 61, the rotary shaft 53 is inserted rotatably through the holes 54, 64, 57 and 55, the pawls 49 and 50 are adjusted so that the recesses 60 thereof receive the projection 59 of the holder 58, and the rotary member 63 is fixed to the rotary shaft 53 so as to rotate together with the rotary shaft 53. When thus assembled, the bodies 78 and 79 of the pawls 49 and 50 are disposed opposite the side surfaces 80 and 81 of the yoke 61, respectively.

Although not illustrated in the drawings, a plurality of sets, for example, nine sets, of the two type rings 13 and 14, the two selection ratchet wheels 25 and 26, the two driving clicks 31 and 32, the two pawls 49 and 50, the two spring members 66 and 67, the one solenoid 56, the one holder 58, the one yoke 61 and the one rotary member 63 are arranged along the rotary shaft 11 and the rotary shaft 53.

The manner of operation of this embodiment thus constructed will be described hereinafter.

Figure 3A:
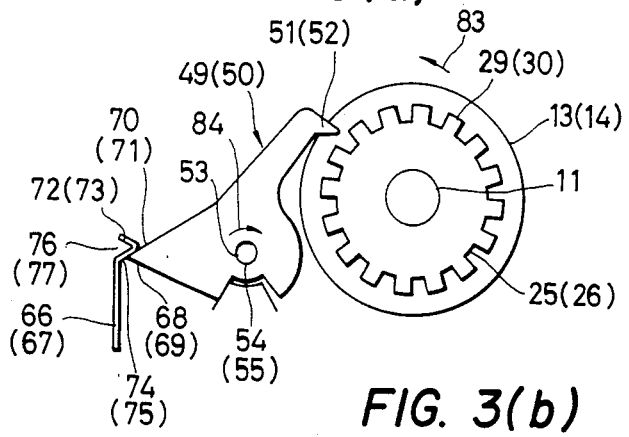
FIGS. 3 (*a*), 3 (*b*) and 3 (*c*) are views of assistance in explaining the relation between a selection ratchet wheel, a pawl and a spring member of the embodiment of FIG. 1, in which the pawl is in a waiting position before being driven in FIG. 3 (*a*), the pawl is engaged with the selection ratchet wheel in FIG. 3 (*b*), and the pawl is disengaged from the selection ratchet wheel in FIG. 3 (*c*).
Figure 3B:
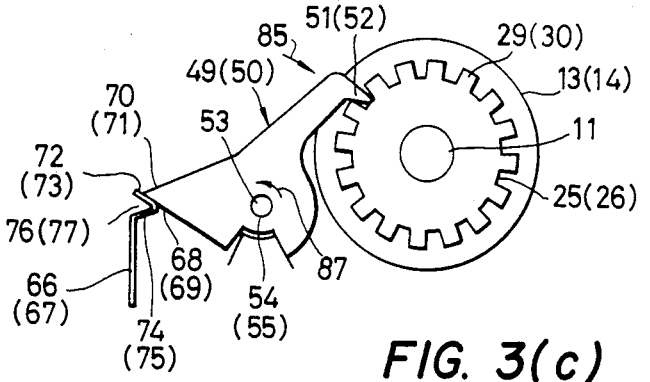
Figure 3C:
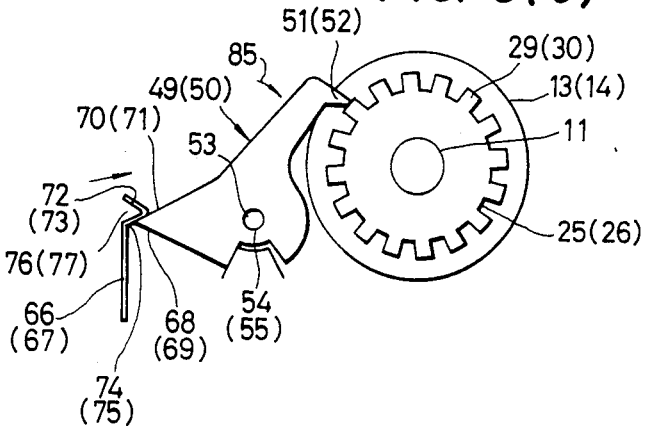

When the rotary shaft 11 is rotated by a motor, not shown, in a direction indicated by an arrow 82 in FIG. 2 (*a*), that is, a direction indicated by an arrow 83 in FIG. 3 (*a*), and the rotary shaft 53 is rotated in a direction indicated by an arrow 84 in FIG. 3 (*a*) in a waiting state where the lower sections 74 and 75 of the bends 76 and 77 of the spring members 66 and 67 engage the upper sides 70 and 71 of the rear ends of the pawls 49 and 50 as shown in FIG. 3 (*a*) and the projections 35 and 36 of the driving clicks 31 and 32 engage the groove 12 of the rotary shaft 11 as shown in FIG. 2 (*a*), the first face 12*a* of the groove 12 presses the second faces 41 and 42 of the driving clicks 31 and 32 to transmit rotative force to the driving clicks 31 and 32 as the rotary shaft 11 rotates. Then, the rotative force is transmitted through the free ends 45 and 46 of the first arms 37 and 38 of the driving clicks 31 and 32 and the guiding faces 47 and 48 of the selection ratchet wheels 25 and 26 to the selection ratchet wheels 25 and 26. The rotative force is transmitted also through the pins 23 and 24 of the type rings 13 and 14 to the type rings 13 and 14 to rotate the type rings 13 and 14 together with the rotary shaft 11 in the direction indicated by the arrow 82. The rotary shaft 53 rotates the rotary member 63 and the yoke 61, however, since the rotative force of the rotary shaft 53 is not transmitted to the pawls 49 and 50, the pawls 49 and 50 are held in the waiting state shown in FIG. 3 (*a*).

Upon the arrival of a desired typeface of the first type ring 13 at a printing position, not shown, opposite the platen, the solenoid 56 is energized to attract the bodies 78 and 79 of the pawls 49 and 50 to the side surfaces 80 and 81 of the yoke 61, respectively. Consequently, the pawls 49 and 50 tend to turn in a direction indicated by an arrow 85 in FIGS. 3 (*b*) and 3 (*c*) together with the yoke 61. Since the claw 51 of the first pawl 49 is located opposite a tooth space of the first teeth 29 of the first selection ratchet wheel 25, the rear end of the pawl 49 is moved over the bend 76 of the spring member 66 as the pawl 49 is turned in the direction indicated by the arrow 85, so that the claw 51 of the pawls 49 engages one of the first teeth 29 of the first selection ratchet wheel 25 to stop the first selection ratchet wheel 25, hence, the first type ring 13. On the other hand, since the phase of the second teeth 30 is shifted from that of the first teeth 29 by half a pitch of the teeth, the claw 52 of the second pawl 50 rests on one of the second teelth 30 as shown in FIG. 3 (*c*). Accordingly, the second type ring 14 continues rotating. In another mode of operation, the solenoid 56 is de-energized in synchronism with the stop of the first type ring 13 to interrupt the transmission of the rotative force of the rotary shaft 53 to the second pawl 50. Then, the second pawl 50 is returned to the waiting position shown in FIG. 3 (*a*) by the resilient force of the spring member 66. Accordingly, the second pawl 50 does not engage the second selection ratchet wheel 26 even when the rotary shaft 53 rotates.

As the rotary shaft 11 rotates continuously in the direction indicated by the arrow 82 in FIG. 2 (*a*) after the first selection ratchet wheel 25 has been stopped by the first pawls 49, the free end 45 of the first arm 37 of the driving click 31 is moved along the guiding face 47 of the first selection ratchet wheel 25 in a direction indicated by an arrow 86 in FIG. 2 (*b*), and thereby the driving click 31 is expanded against the resilience of the second arm 39. Consequently, the projection 35 of the first arm 37 is moved away from the groove 12 of the rotary shaft 11, so that the transmission of the rotative force of the rotary shaft 11 to the first selection ratchet wheel 25, hence, the first type ring 13, is interrupted.

Thus the desired typeface of the first type ring 13 is positioned at the printing position. In this state, the first pawls 49 is held in engagement with one of the first teeth 29 of the first selection ratchet wheel 25 by the resilient force of the spring member 66.

A desired typeface of the second type ring 14 is positioned at the printing position in substantially the same manner. That is, upon the arrival of the desired typeface of the second type ring 14 at a position near the printing position opposite the platen, not shown, the solenoid 56 is energized, and thereby the second pawl 50 turns together with the yoke 61 in the direction indicated by the arrow 85 in FIG. 3 (*b*) while the rear end thereof moves over the bend 77 of the spring member 67 and the claw 52 of the second pawl 50 engages one of the second teeth 30 to stop the second selection ratchet wheel 26. Also, the driving click 32 is expanded in the same manner as that mentioned above to disconnect the second selection ratchet wheel 26, hence, the second type ring 14, from the rotary shaft 11.

The typefaces of the type rings other than those shown in the drawings are positioned at the printing position in the same manner to carry out printing operation.

At the completion of printing operation, the solenoid 56 is energized to attract the pawls 49 and 50 to the yoke 61, and then the rotary shaft 53 is reversed in a direction indicated by an arrow 87 in FIG. 3 (*b*) to turn the pawls 49 and 50 so that the lower sides 68 and 69 of the rear ends of the pawls 49 and 50 are moved over the bends 76 and 77 of the spring members 66 and 67, respectively, and the pawls 49 and 50 are disengaged from the selection ratchet wheels 25 and 26, respectively. When the rotary shaft 11 is reversed in a direction indicated by an arrow 88 in FIG. 2 (*b*), the projections 35 and 36 of the first arms 37 and 38 of the driving clicks 31 and 32 are caused to engage the groove 12 of the rotary shaft 11 by the resilience of the second arms 39 and 40 of the driving clicks 31 and 32, and thereby the state shown in FIG. 2 (*a*) is established. In the state shown in FIG. 2 (*a*), the rotative force of the rotary shaft 11 is transmittable to the selection ratchet wheels 25 and 26 and the type rings 13 and 14. The pawls, the driving clicks, the selection ratchet wheels, the type rings and other parts of the sets, not shown, other than those shown in the drawings operate entirely in the same manner.

In this embodiment thus constructed, since the phase of the first teeth 29 of the first selection ratchet wheel 25 is shifted from that of the second teeth 30 of the second selection ratchet wheel 26 by half a pitch of the teeth, either the selection ratchet wheel 25 or 26 continues turning when the other is stopped, and hence the typefaces of the first type ring 13 and those of the second type ring 14 are capable of being located at the printing position. Furthermore, since the operation for stopping the selection ratchet wheels 25 and 26 is achieved by a single electromagnetic clutch comprising the solenoid 56, the yoke 61 and the rotary member 63, only a reduced number of driving sources for stopping the selection ratchet wheels 25 and 26 and other ratchet wheels, not shown.

Since the the rotation of the selection ratchet wheels 25 and 26 is stopped through the turning motion of the pawls 49 and 50 having the claws 51 and 52 which engage the teeth 29 and 30 of the ratchet wheels 25 and 26, respectively, the selection ratchet wheels 25 and 26, hence, the type rings 13 and 14 can be surely stopped.

Furthermore, since the selection ratchet wheels 25 and 26 and the type rings 13 and 14 are individual members, guiding faces 47 and 48 for turning the driving clicks 31 and 32 are formed in the selection ratchet wheels 25 and 26, the first face 12 extending within a radial plane including the center O of the rotary shaft 11 is formed in the groove 12 of the rotary shaft 11, the second faces 41 and 42 which fit the first face 12*a* are formed in the projections 35 and 36 of the first arms 37 and 38 of the driving clicks 31 and 32, respectively, and the first face 12*a* of the groove 12 presses the second faces 41 and 42 of the projections 35 and 36 as the rotary shaft 11 rotates to select a typeface, that is, since the rotative force of the rotary shaft can be transmitted to the type rings 13 and 14 scarcely being affected by the friction between the rotary shaft 11 and the projections 35 and 36, the respective resiliences of the driving clicks 31 and 32 can be reduced to the least possible extent even for high-speed printing operation, and hence only a reduced torque is necessary to drive the rotary shaft 11. Therefore, only a small motor is able to drive the rotary shaft 11. Furthermore, the driving clicks 31 and 32 can be mounted on the type rings 13 and 14, respectively, through simple work and assembling the printing mechanism requires reduced time and labor.

Still further, since the driving clicks 31 and 32 integrally have projections 35 and 36 fitting the groove 12 of the rotary shaft 11, the rigid first arms 37 and 38 and the elastic second arms 39 and 40, respectively, and the driving clicks 31 and 32 are retained steadily on the pins 23 and 24 received in the holes 33 and 34 by the resilience of the second arm 39 and 40, the driving clicks 31 and 32 are retained surely in place on the type rings 13 and 14 and able to surely transmit the rotative force of the rotary shaft 11 to the type rings 13 and 14, respectively. The driving clicks 31 and 32 can be easily mounted on the type rings 13 and 14, respectively.

Furthermore, since the protrusions 21 and 22 are formed on the bosses 17 and 18 of the type rings to keep the second arms 39 and 40 of the driving clicks 31 and 32 away from the bosses 17 and 18, the driving clicks 31 and 32 can be strained to give the same an initial stress, and hence the inherent resilience of the driving clicks 31 and 32 may be small. Thus the driving clicks 31 and 32 can be fabricated at a low manufacturing cost.

Still further, since the spring members 66 and 67 capable of holding the pawls 49 and 50 in engagement with and separate from the selection ratchet wheels 25 and 26, respectively, are provided, the pawls 49 and 50 can be disengaged from the selection ratchet wheels 25 and 26 simply by energizing the solenoid 56 and reversing the rotary shaft 53, without requring any cam or the like. Thus the construction of the mechanism for releasing the pawls 49 and 50 is simple.

As apparent from what has been described hereinbefore, according to the present invention, the number of the driving sources for stopping the type rings can be reduced by half as compared with the corresponding conventional printing mechanism. That is, the selection of typefaces of two type rings can be achieved with a single driving source. Therefore, the manufacturing cost of the printing mechanism of the present invention is lower than that of the corresponding conventional printing mechanism and the design conditions of the same are less restrictive than those of the conventional printing mechanism.

Particularly, since the selection ratchet wheels, hence the type rings, are stopped by the turning motion of the pawls for stopping the selection ratchet wheels, the type rings can be surely stopped at a desired position.

Although the invention has been described in its preferred form with a certain degree of particularity, obviously many modifications and variations of the present invention are possible in the light of the above teachings. It is therefore to be understood that various chamges and modifications may be made in the invention without departing from the spirit and scope thereof.

What is claimed is:

1. A printing mechanism comprising:

a first rotary shaft;

a first type ring mounted on the first rotary shaft and provided on its circumference with a plurality of first typefaces;

a first selection ratchet wheel on the first rotary shaft rotatable together with the first type ring and provided on its circumference with a plurality of first teeth corresponding to the position of the first typefaces, respectively;

a second type ring mounted on the first rotary shaft beside the first type ring and provided on its circumference with a plurality of second typefaces;

a second selection ratchet wheel on the first rotary shaft rotatable together with the second type ring and provided on its circumference with a plurality of second teeth corresponding to the positions of the second typefaces, respectively;

drive means engageable between the first rotary shaft and the first and second type rings for driving the type rings together in rotation when they are in a waiting state;

said first type ring and said first selection ratchet wheel and said second type ring and said second selection ratchet wheel being disposed in the waiting state such that the phase of the first teeth are shifted relative to that of the second teeth;

a first driving pawl mounted between said first type ring and said first selection ratchet wheel for transmitting a rotational force of said first rotary shaft to said first type ring;

a second driving pawl mounted between said second type ring and said second selection ratchet wheel for transmitting a rotational force of said first rotary shaft to said second type ring;

a second rotary shaft in parallel with the first rotary shaft;

an electromagnetic clutch mounted on said second rotary shaft;

a first engagement pawl mounted on the second rotary shaft which is movable upon one energization of said clutch from a first position wherein it is not engaged with the teeth of the first selection ratchet wheel to a second position wherein it is engageable with a selected one of the teeth of the first selection ratchet wheel for stopping the first type ring rotated on the first rotary shaft at a position corresponding to a selected typeface thereon, wherein upon stopping said first type ring, said first driving pawl becomes disengaged from transmitting the rotational force of said first rotary shaft to said first type ring;

a second engagement pawl mounted on the second rotary shaft which is movable upon said one energization of said clutch from a first position wherein it is not engaged with the teeth of the second selection ratchet wheel to a second position wherein it is engageable with a selected one of the teeth of the second selection ratchet wheel for stopping the second type ring at a position corresponding to a selected typeface thereon, wherein upon stopping said second type ring, said second driving pawl becomes disengaged from transmitting the rotational force of said first rotary shaft to said second type ring;

wherein upon a single energization of the electromagnetic clutch to move both the first and second engagement pawls to their second positions, one of the two pawls becomes engaged with the teeth of its respective selection ratchet wheel and the other pawl is kept not engaged with the teeth of its respective selection ratchet wheel due to the shifted phases of the teeth of the selection ratchet wheels, whereby said one electromagnetic clutch is selectively energizable to control the positioning of the typefaces of the two type rings.

2. A printing mechanism according to claim 1, wherein spring members for holding said first and second pawls in engagement with and separate from said first and second selection ratchet wheels, respectively, are provided.

* * * * *